US006476789B1

(12) United States Patent
Sakaguchi et al.

(10) Patent No.: US 6,476,789 B1
(45) Date of Patent: Nov. 5, 2002

(54) SYSTEM CONSTRUCTION OF SEMICONDUCTOR DEVICES AND LIQUID CRYSTAL DISPLAY DEVICE MODULE USING THE SAME

(75) Inventors: Nobuhisa Sakaguchi, Tenri (JP); Shigeki Tamai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/441,200

(22) Filed: Nov. 16, 1999

(30) Foreign Application Priority Data

Nov. 20, 1998 (JP) ..... 10-331557

(51) Int. Cl.[7] ..... G09G 3/36

(52) U.S. Cl. ..... 345/100; 345/87; 345/211; 345/213

(58) Field of Search ..... 345/211, 212, 345/213, 87, 88, 100

(56) References Cited

U.S. PATENT DOCUMENTS 5,828,357 A 10/1998 Tamai et al.
6,002,384 A 12/1999 Tamai et al.
6,011,533 A * 1/2000 Aoki ..... 345/92
6,040,828 A * 3/2000 Park ..... 345/213
6,215,459 B1 * 4/2001 Reddy et al. ..... 345/3

FOREIGN PATENT DOCUMENTS

| | | |
|---|---|---|
| JP | A6-3684 | 1/1994 |
| JP | 06-109804 | 4/1994 |
| JP | A7-321632 | 12/1995 |

* cited by examiner

*Primary Examiner*—Richard Hjerpe
*Assistant Examiner*—Kimnhung Nguyen

(57) ABSTRACT

A system construction of semiconductor devices, in which a plurality of semiconductor devices of similar properties are cascaded, each of the semiconductor devices including a clock half-period delaying means which delays a propagation and a reference signal by a half period of the reference signal relative to the input signals before outputting the signals. The propagation signal and the reference signal are cascaded and propagated to the plurality of semiconductors.

20 Claims, 12 Drawing Sheets

. . .

SYSTEM CONSTRUCTION OF SEMICONDUCTOR DEVICES AND LIQUID CRYSTAL DISPLAY DEVICE MODULE USING THE SAME

FIELD OF THE INVENTION

The present invention relates to a system construction of semiconductor devices, that has a plurality of the same semiconductor devices in a cascade connection, and further concerns a liquid crystal display device module using the system construction of the semiconductor devices.

BACKGROUND OF THE INVENTION

As shown in FIG. 10, a conventional liquid crystal display device module has a semiconductor device system, in which source driver LSI (large Scale Integrated Circuit) chips 51 and gate driver LSI chips 52 are respectively mounted on TCPs (Tape Carrier Package) 53. Further, the output terminals of the source driver LSI chips 51 and the gate driver LSI chips 52 are subjected to a thermocompression bonding and are electrically connected to terminals (not shown) made of ITO (Indium Tin Oxide) on a liquid crystal panel 54 via, for example, an ACF (Anisotropic Conductive Film).

Also, the TCPs 53 are electrically connected with a flexible substrate 55 in the same manner as the output terminals of the source driver LSI chips 51 and the gate driver LSI chips 52. With this arrangement, color image data signals (three kinds of signals, R·G·B) are supplied to the source driver LSI chips 51, and control signals and source lines, etc. are supplied to the source driver LSI chips 51 or the gate driver LSI chips 52, from a controller circuit 56 via lines disposed on the flexible substrate 55.

Here, eight TCPs 53 have the source driver LSI chips 51 and serve as first through eighth source drivers. Namely, eight source driver LSI chips 51 of the same structure are cascaded. Additionally, in this arrangement, two gate driver LSI chips 52 are cascaded.

In the liquid crystal panel 54, the number of pixels is 800 pixels×3(RGB)[source]×600 pixels[gate].

The first through eighth source drivers provide a 64-gray scale display and respectively drive 100 pixels×3(RGB).

As shown in FIG. 11, each of the source driver LSI chips 51 of the source drivers is constituted by a shift resister circuit 61, a data latch circuit 62, a sampling memory circuit 63, a hold memory circuit 64, a reference source generating circuit 65, a DA converter circuit 66, and an output circuit 67.

In the shift resister circuit 61, as a start pulse, a start-pulse input signal SPI (signal) is outputted from a terminal SSPI of the controller circuit 56 and inputted to a terminal SPin of the source driver LSI chip 51 in synchronization with a horizontal synchronizing signal of the image data signals R·G·B (signal). Further, afterwards, the shift resister circuit 61 shifts the start-pulse input signal SPI in response to a clock signal CK (reference signal) which is outputted from an SCK terminal of the controller circuit 56.

The start-pulse input signal SPI, which has been shifted in the shift resister circuit 61, is outputted from a terminal SPout of the source driver LSI chip 51 as an output of the final step and inputted to a terminal SPin of the next source driver LSI chip 51. Moreover, the clock signal CK is inputted to an input terminal CKin, outputted from an output terminal CKout, and inputted to a terminal CKin of the next source driver LSI chip 51.

In the same manner, the start pulse input signal SPI is shifted to the final step of the shift resister circuit 61 of the source driver LSI chip 51 in the eighth source driver shown in FIG. 10.

Meanwhile, the image data signals R·G·B, which are respectively outputted from R·G·B terminals of the controller circuit 56, are constituted by 6-bit R·G·B signals. As shown in FIG. 11, the image data signals R·G·B are respectively inputted in parallel from a terminal R1-6in, a terminal G1-6in, and a terminal B1-6in of the source driver LSI chip 51. And then, the image data signals R·G·B are temporarily latched in the data latch circuit 62 and are transmitted to the sampling memory circuit 63.

The sampling memory circuit 63 performs a sampling on image signal data containing 6-bit R·G·B, 18 bits in total, that are transmitted in a time division, in accordance with an output signal from each step of the shift resister circuit 61. The sampling memory circuit 63 stores the sampled image signal data until a latch signal LS (described later), which is outputted from an LS terminal (see FIG. 3, an explanatory drawing of the present invention) of the controller circuit 56, is inputted.

Next, the image signal data is inputted to the hold memory circuit 64, and the latch signal LS latches the image signal data when the image data signals R·G·B of one horizontal period are inputted to the hold memory circuit 64. And then, the hold memory circuit 64 holds the data until data of the next horizontal period is inputted from the sampling memory circuit 63 to the hold memory circuit 64; meanwhile, the image signal data is outputted.

The reference source generating circuit 65 generates, for example, 64-level voltage for a gray-scale display by using a resistance division, in accordance with a reference voltage which is outputted from a terminal Vref 1–9 (see FIG. 3, an explanatory drawing of the present invention) of the controller circuit 56 and is inputted to a terminal Vref 1–9 of the source driver LSI chip 51.

The DA converter circuit 66 converts digital 6-bit image signals R·G·B to analog signals. And then, the output circuit 67 amplifies the 64-level analog signals in accordance with a voltage, which is outputted from the controller circuit 56 and is inputted to a terminal VLS of the source driver LSI chip 51, and the analog signals are outputted from output terminals XO1~XO100, YO1~YO100, and ZO1~ZO100 to terminals (not shown) of the liquid crystal panel 54.

The output terminals XO, YO, and ZO respectively correspond to the image data signals R·G·B, and each of XO, YO, and ZO has 100 terminals. Additionally, a terminal Vcc and a terminal GND of the source driver LSI chip 51 are terminals for power supplied to the source driver LSI chip 51. Here, in FIG. 11, a buffer circuit is omitted.

The above description discussed the construction and operation of the source driver having a 64-step gradation.

Here, since the gate driver LSI chip 52 basically has the same construction as the source driver LSI chip 51, the description thereof is omitted.

Regarding such a system construction of the semiconductor devices in the liquid crystal display device module, the number of pixels is increasing and resolution is becoming higher. Due to an increase in the number of pixels, the source driver LSI chips 51 and the gate driver LSI chips 52 need to realize a high-speed transmission of the image data signals R·G·B, namely, a high-frequency clock operation. This tendency is more outstanding in the source driver LSI chips 51 than in the gate driver LSI chips 52.

For instance, when the source has 800 pixels and the gate has 600 pixels, the clock signal CK is set at nearly 65 MHz.

When the high-frequency clock signal CK is supplied to the each of the source driver LSI chips 51 via the flexible substrate 55, stray capacitance grows so as to deform a clock waveform, resulting in a malfunction. Therefore, in the system construction of the semiconductor devices, as shown in FIG. 10, the adjacent TCPs 53 overlap each other so as to electrically connect wires, and the clock signal CK is outputted via the buffer circuit (not shown) in the source driver LSI chip 51 and is inputted to the next source driver LSI chip 51. This arrangement makes it possible to successively pass the clock signal CK through all the cascaded source driver LSI chips 51 of the first through eighth source drivers.

Japanese Unexamined Patent Publication No. 3684/1994 (Tokukaihei 6-3684, published on Jan. 14, 1994) discloses a method in which the adjacent TCPs 53 overlap each other so as to connect wires. In this method, a stray capacitance is small between the source driver LSI chips 51 so as to reduce deformation on a waveform.

However, regarding the conventional system construction of semiconductor devices and the liquid crystal display device module using the system construction of the semiconductor devices, due to a higher frequency of the clock signal CK and a cascade connection of IC chips having the similar properties, the following problem occurs.

Generally, a delay time dt1 resulted from a rise time (when 10% level is raised to 90% level) of the clock signal CK is set so as to be equal to a delay time td2 resulted from a fall time (when 90% level is lowered to 10% level) of the clock signal CK.

For instance, regarding a clock buffer circuit constituted by a P-channel MOS (Metal Oxide Semiconductor) and an N-channel MOS, for example, a gate width of the P-channel MOS is increased to obtain a larger driving ability.

However, the delay time td1 at a rise time cannot be equal to the delay time td2 at a fall time of the clock signal CK. Upon completion of manufacturing, for example, a property difference of nearly 1 nsec. normally appears. Moreover, an LSI threshold voltage Vth varies for each of the LSIs due to a change in processing conditions. Specifically, for example, when the delay time is about 2 nsec. at a rise time, the delay time may be about 3 nsec. at a fall time. FIG. 12 shows a timing chart obtained by cascading the plurality of LSIs and transmitting a signal through the LSIs.

Namely, when N LSI chips having the similar properties are cascaded, a 1 nsec. difference per LSI chip is accumulated to be: the difference in delay time (1 nsec.)×N. Hence, as shown in FIG. 12, a low-level period is narrowed.

As described above, when the clock signal CK is about 65 MHz, one period is about 15 nsec. and a low-level period is about 8 nsec. at a duty ratio of 50%. Here, upon cascading eight source driver LSI chips 51 (N=8) having the above-mentioned properties, a low-level period of the clock signal CK is less than 1 nsec. in the source driver LSI chip 51 of the final step; therefore, the clock signal CK cannot obtain the minimum tolerance time of the low-level period, that is required for driving the source driver LSI chip 51. Consequently, the source driver LSI chips 51 has a malfunction and lose stability, thereby decreasing reliability.

Furthermore, FIG. 12 shows the input of the clock signal CK to the first source driver on the assumption that the waveform has a duty ratio of 50%. However, in an actual system construction, a stray capacitance becomes the largest on a line from the controller circuit 56 via the wires of the flexible substrate 55 to the first source driver. Additionally, on a line from the controller circuit 56 via the wires of the flexible substrate 55 to the first source driver, the stray capacitance greatly fluctuates due to the construction including the shape of the installed LSI.

The waveform deformation and unevenness affect as well as the accumulation of delay times of the source driver LSI chips 51; thus, it is extremely difficult to grantee reliability until the final step of the source driver LSI chips 51.

Considering a further increase in number of pixels, this problem is serious.

SUMMARY OF THE INVENTION

An objective of the present invention is to provide a system construction of semiconductor devices that can prevent a malfunction and a halt of the system so as to construct a highly reliable system when a plurality of the same semiconductor devices are cascaded, and to provide a liquid crystal display device module using the system construction of the semiconductor devices.

In order to achieve the above objective, the system construction of the semiconductor devices of the present invention, in which a plurality of semiconductor devices of similar properties are cascaded, is characterized in that each of the semiconductor devices includes a half-period delaying means which delays a propagation signal and a reference signal by a half period of the reference signal relative to the input signals before outputting the signals, said propagation signal and the reference signal being cascaded and propagated to the plurality of semiconductor devices.

When the plurality of semiconductor devices of similar properties are cascaded, and signals such as a start pulse signal and an image data signal, and a reference signal such as a clock signal are cascaded and propagated to the semiconductor devices, delays appear in each of the semiconductor devices. The delays are supposed to be the same at a rise time and at a fall time of the signals and the reference signal; however, the delay times are different from each other in an actual operation. Consequently, in the semiconductor device located at the end, the accumulation of the delay time differences shortens the low-level periods of the signals and the reference signal so as to cause a malfunction and a halt of the system.

However, according to the present invention, each of the semiconductor devices is provided with the half-period delaying means. The half-period delaying means delays the propagation signals and the reference signal, which are cascaded and propagated to the plurality of cascaded semiconductor devices, by a half period of the reference signal relative to the input signals before outputting the signals.

Namely, the propagation signals and the reference signal are delayed by a half-period of the reference signal relative to the input signals, so that it is possible to shift a rise time and a fall time of the propagation signal and the reference signal between the odd-numbered semiconductor devices and the even-numbered semiconductor devices. Therefore, even when the delay times of the signal and the reference signal are different at a rise time and a fall time in each of the semiconductor devices, the delay times can be cancelled so as to cause no accumulation of the delay time differences. As a result, in the case of the faster reference signal, namely, a faster clock, and an increase in the cascaded semiconductor devices, it is possible to propagate an appropriate clock to the semiconductor device located at the end so as to eliminate the cause of a malfunction.

Hence, upon cascading the plurality of semiconductor devices having a similar property, it is possible to provide the system construction of the semiconductor devices that can prevent a malfunction and a halt of the system so as to construct a highly reliable system.

For a fuller understanding of the nature and advantages of the invention, reference should be made to the ensuing detailed description taken in conjunction with the accompanying drawings.

DESCRIPTION OF THE EMBODIMENTS

Referring to FIGS. 1 through 9, the following explanation describes one embodiment of the present invention.

Figure 2:
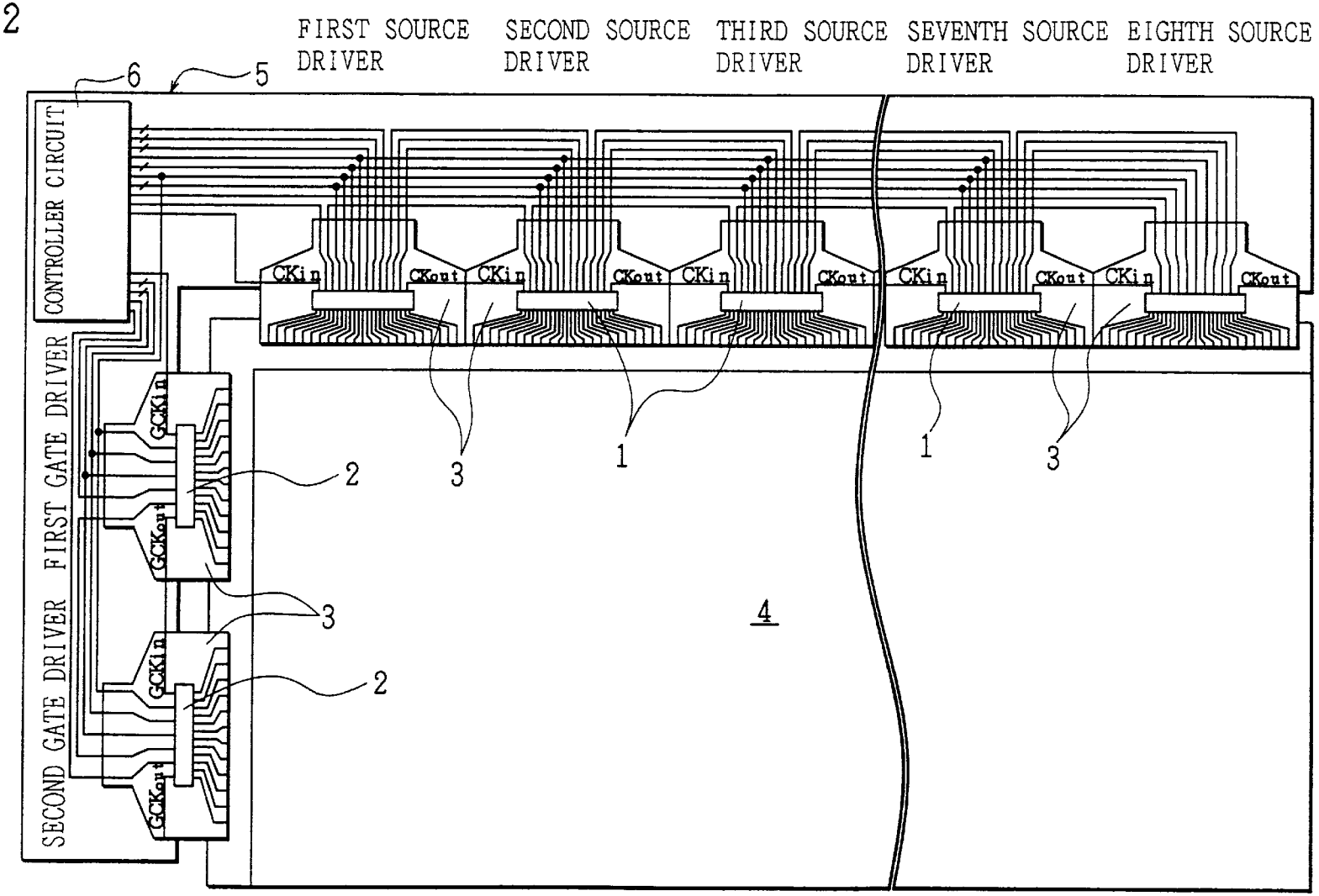
FIG. 2 is a schematic plan view showing the system construction of the semiconductor devices in the liquid crystal display device module.

As shown in FIG. 2, in a system construction of semiconductor devices in a liquid crystal display device module of the present embodiment, source driver LSI chips 1 and gate driver LSI chips 2, that serve as semiconductor devices, are mounted respectively on TCPs (Tape Carrier Package) 3. Here, a TCP is a thin package in which an LSI chip is bonded to a tape film.

Figure 7:
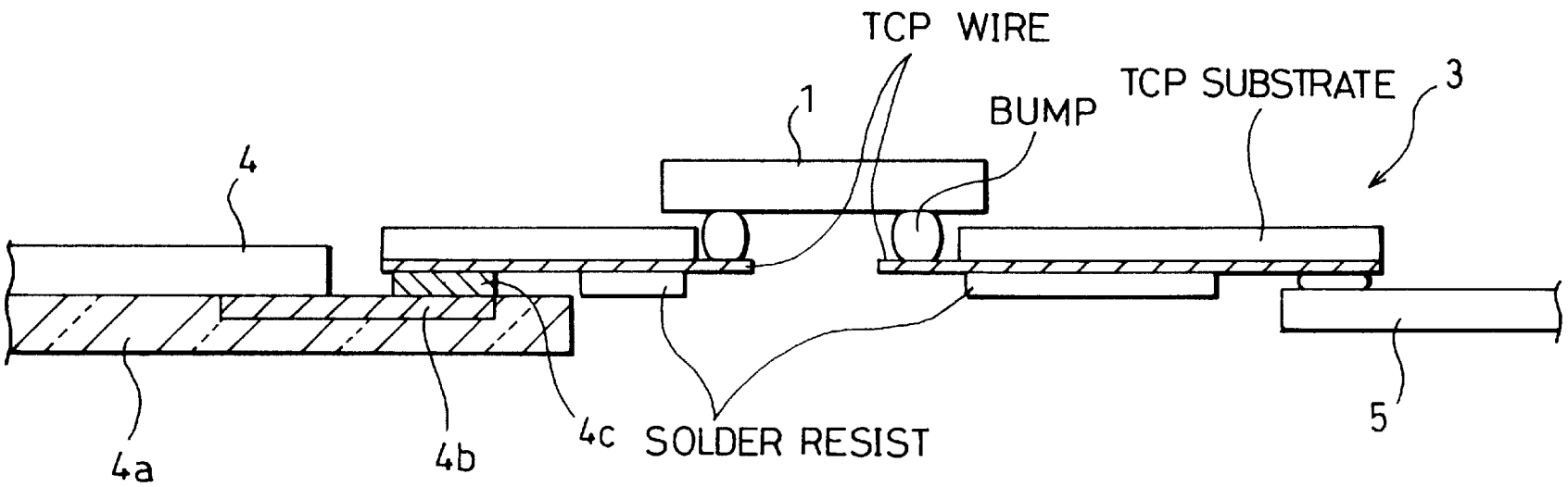
FIG. 7 is a sectional view schematically showing a liquid crystal panel mounted on a TCP in the liquid crystal display device module.

As shown in FIG. 7 (described later), the output terminals of the TCPs 3 are subjected to a thermocompression bonding so as to be electrically connected to terminals 4*b* made of ITO (Indium Tin Oxide) on a liquid crystal glass substrate 4*a* of a liquid crystal panel 4 via, for example, an ACF (Anisotropic Conductive Film) 4*c*.

Meanwhile, as shown in FIG. 2, signals are inputted to the source driver LSI chips 1 and the gate driver LSI chips 2 via TCP wires and wires of a flexible substrate 5.

With this arrangement, color image data signals R·G·B (three kinds of 6-bit signals R·G·B) are supplied to the source driver LSI chips 1, and control signals and power lines, etc. are supplied to the source driver LSI chips 1 and the gate driver LSI chips 2, from a controller circuit 6 via the wires on the flexible substrate 5. Meanwhile, a start pulse signal SP is inputted from a terminal SSPI of the controller circuit 6 to a terminal SPin of a first source driver. And then, the start pulse signal SP is outputted as a start pulse output signal SPO from a terminal SPout and is inputted to a terminal SPin of the next source driver. Although a clock signal CK can pass through the flexible substrate 5, in the present embodiment, the wires are arranged not via the flexible substrate 5 because the clock signal CK runs at an extremely high speed.

In the present embodiment, eight TCPs 3 are provided for mounting the source driver LSI chips 1, as first through eighth source drivers. Thus, the eight source driver LSI chips 1 are cascaded. Further, two gate driver LSI chips 2 are cascaded in the present embodiment.

The number of pixels is 800 pixels×3(RGB)[source]×600 pixels[gate] in the liquid crystal panel 4. This number is the same as that of the conventional art.

The following explanation describes various kinds of signals and paths thereof with respect to the liquid crystal display module having the above-mentioned construction.

Figure 3:
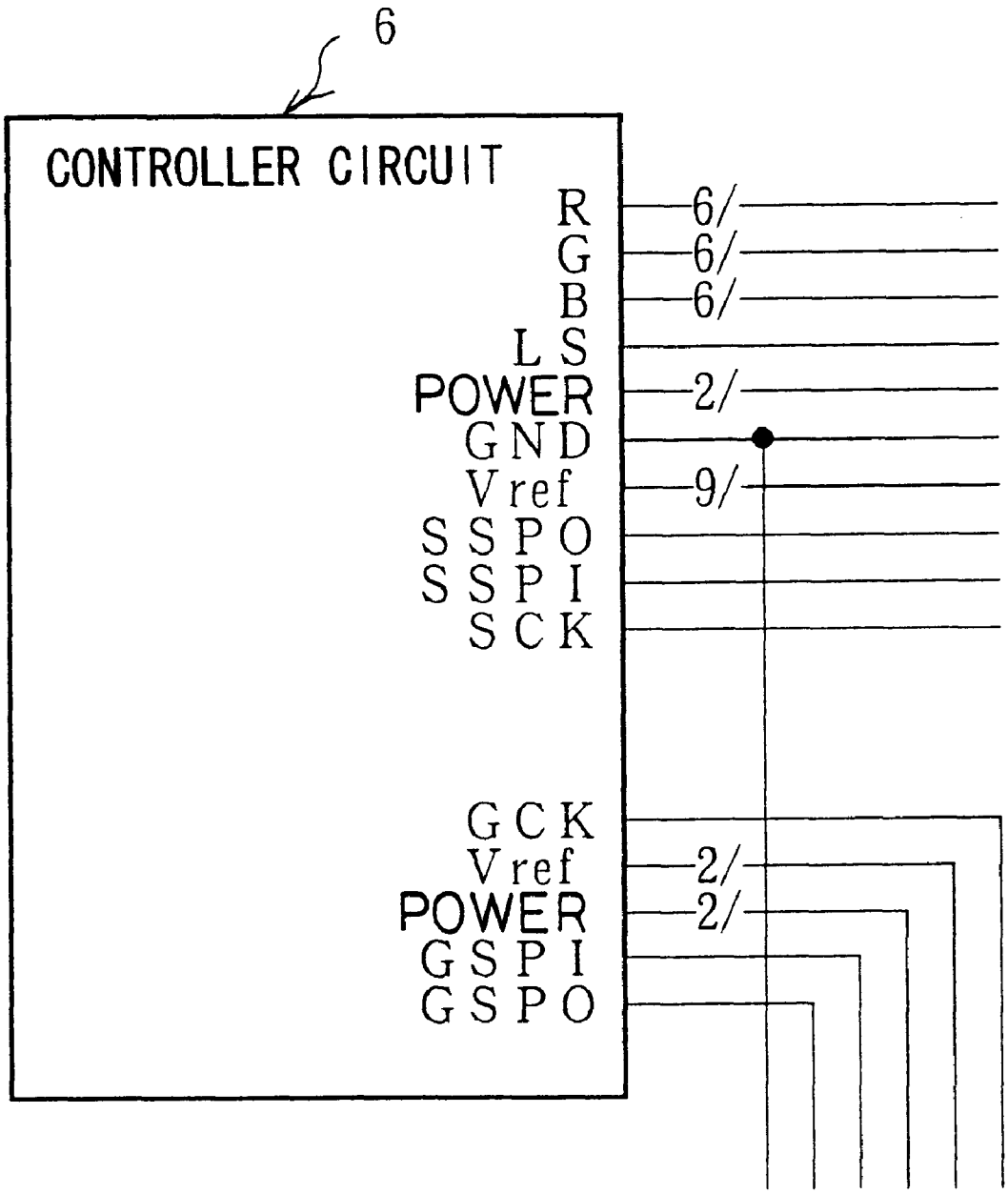
FIG. 3 is an explanatory drawing showing each terminal of a controller circuit in the source driver LSI chip.

Firstly, as shown in FIGS. 2 and 3, the 6-bit image data signals R·G·B to the source driver LSI chips 1, the clock signal CK, and a start pulse input signal SPI are outputted from the controller circuit 6 and are inputted via wires on the flexible substrate 5 and wires of TCPs 3 to the source driver LSI chip 1 of the first source driver.

Figure 1:
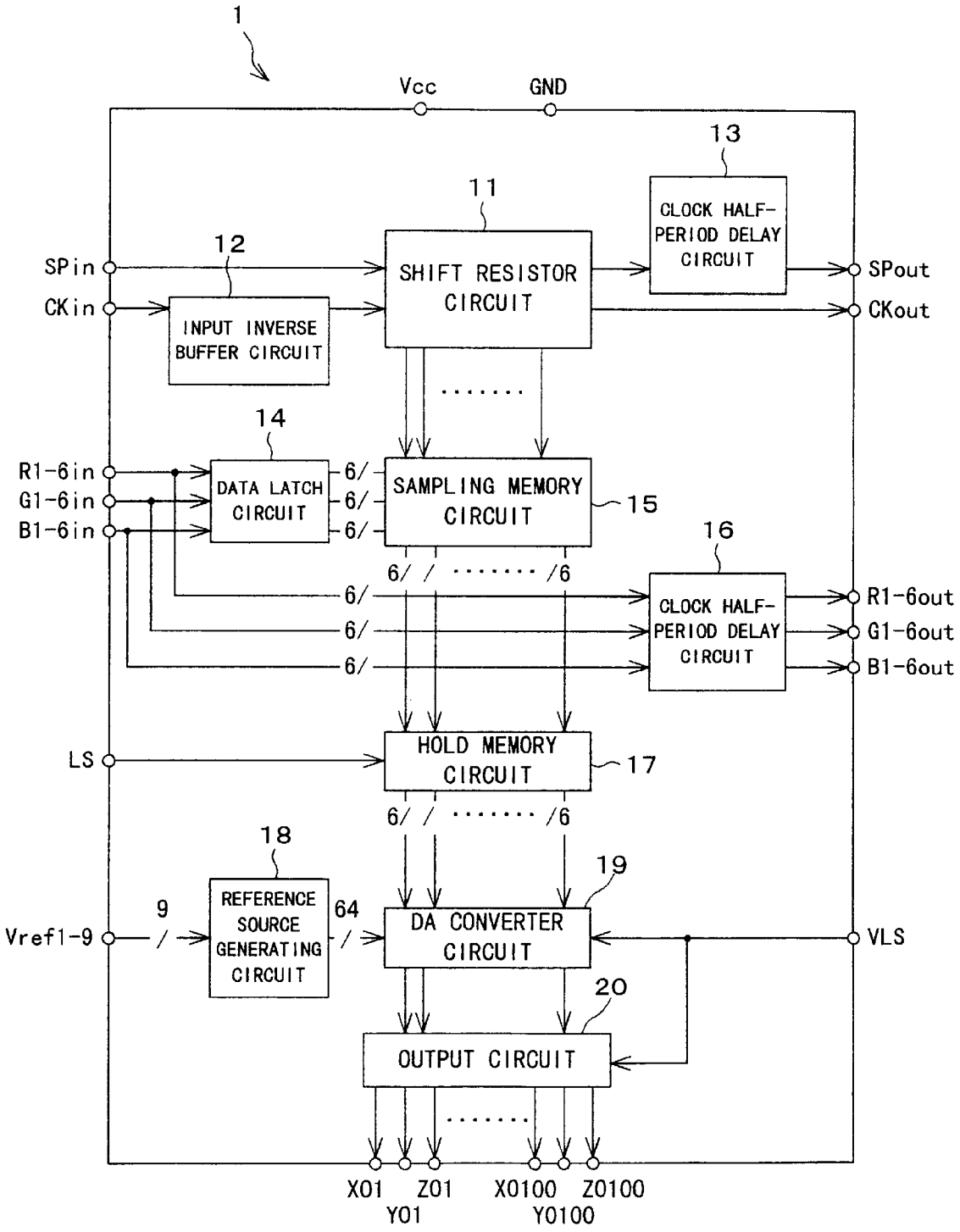
FIG. 1 is a block diagram showing one embodiment of a system construction of semiconductor devices and a liquid crystal display device module using the system construction of the semiconductor devices, and a construction of a source driver LSI chip.

The image data signals R·G·B which are outputted from the source driver LSI chip 1 of the first source driver are inputted from terminals R1-6out, G1-6out, and B1-6out of FIG. 1 via the flexible substrate 5 to the source driver LSI chip 1 of the second source driver of the next step.

Further, in the same manner, the start pulse output signal SPO outputted from the source driver LSI chip 1 of the first source driver is inputted from the terminal SPout to the source driver LSI chip 1 of the second source driver of the next step.

Moreover, the clock signal CK is outputted from a terminal CKout of the source driver LSI chip 1 in the first source driver and is sent to the source driver LSI chip 1 of the second source driver, not via the flexible substrate 5, as shown in FIG. 2.

Afterwards, in the same manner, a connection is made from the third to eighth source drivers.

The start pulse output signal SPO is inputted from the eighth source driver via the wires of the flexible substrate 5 to a terminal SSPO of the controller 6.

Additionally, a source terminal Vcc of the source driver LSI chip 1, a terminal GND line, voltage Vrefs 1 through 9 for a 64-gray scale display, a voltage VLS for adjusting a voltage applied to the liquid crystal panel 4, and a latch signal LS are supplied as common signals from the controller circuit 6 to each of the source driver LSI chips 1 of the first through eighth source drivers.

Also, in the same manner, the gate driver LSI chips 2 are mounted on the TCPs 3 and are electrically connected with the terminals of the liquid crystal panel 4 and the flexible substrate 5.

Additionally, from the controller circuit 6, a gate driver clock signal GCK and a gate driver start pulse signal GSPI are inputted to the gate driver LSI chip 2 of the first gate driver.

Figure 9:
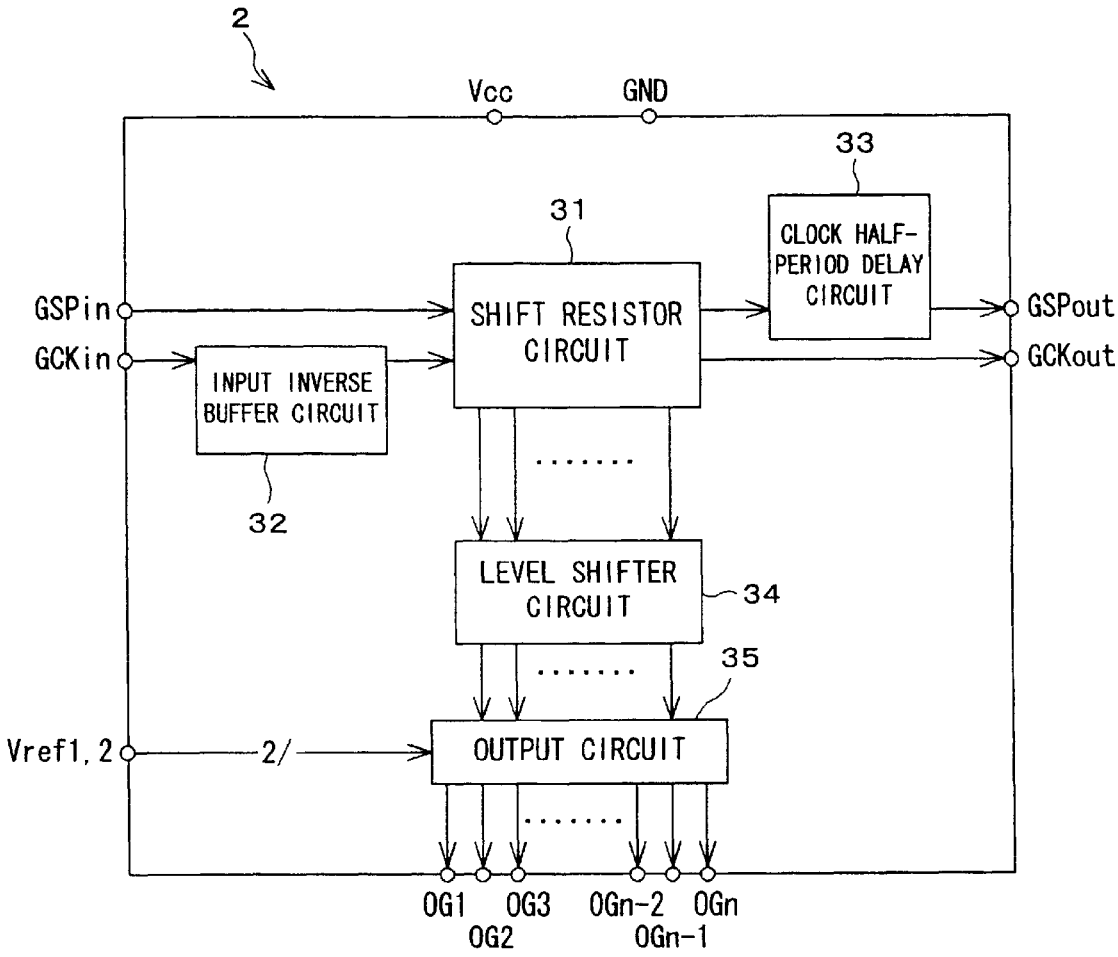
FIG. 9 is a block diagram showing a construction of a gate driver LSI chip in the liquid crystal display device module.
Figure 10:
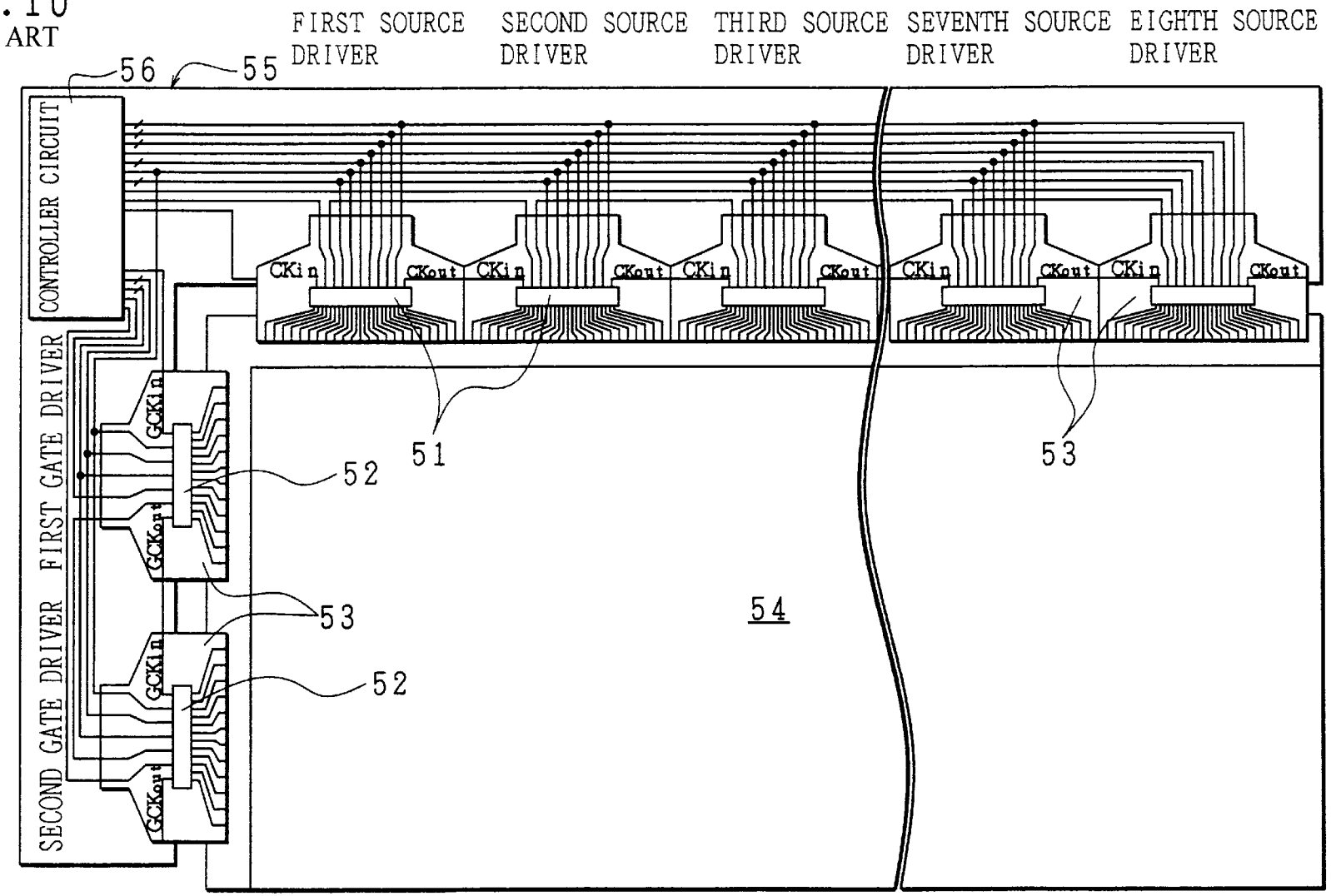
FIG.10 PRIOR ART
FIG. 10 is a schematic plan view showing a conventional system construction of semiconductor devices, a liquid crystal display device module using the system construction of the semiconductor devices, and the system construction of the semiconductor devices in the liquid crystal display device module.
Figure 11:
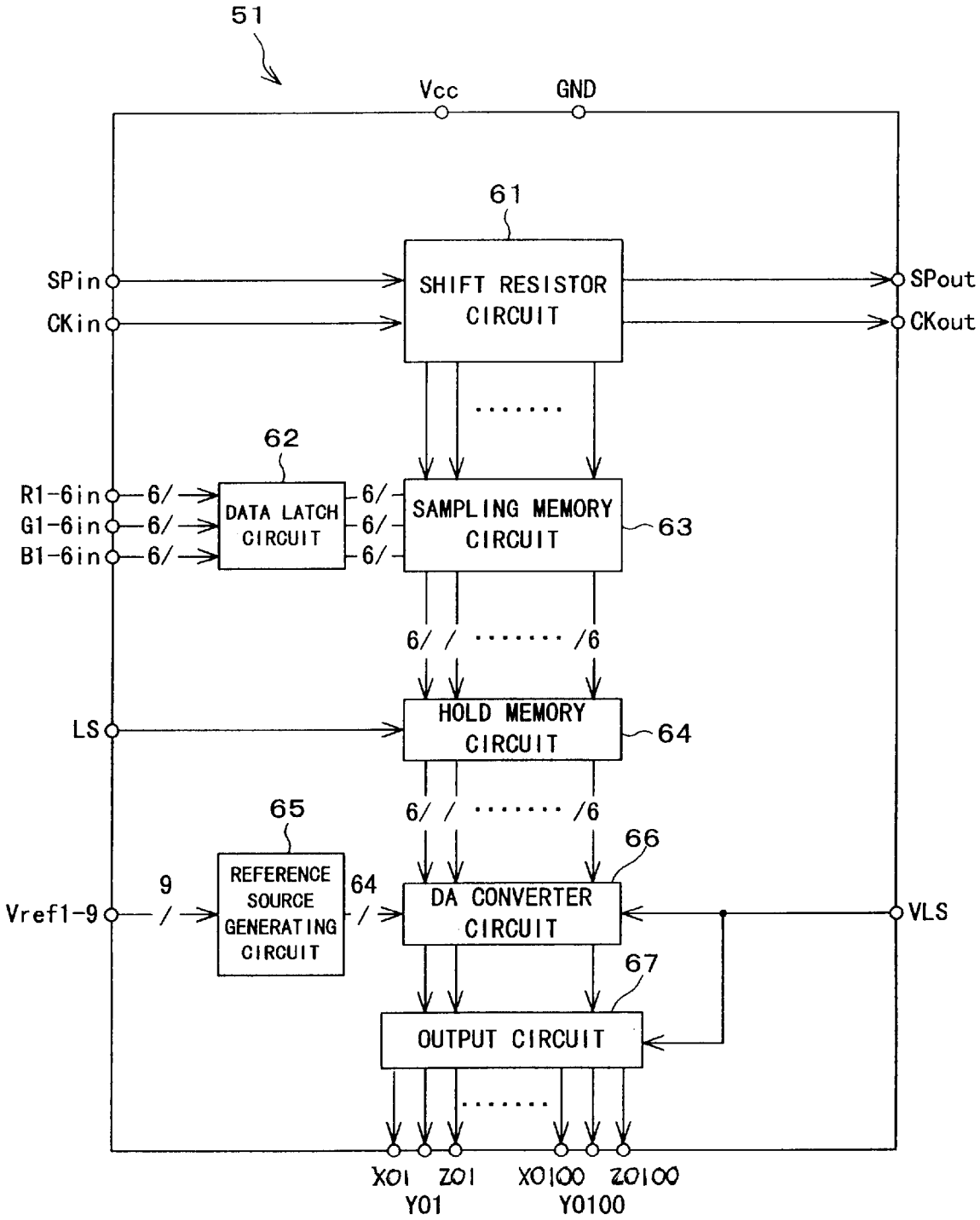
FIG. 11 PRIOR ART
FIG. 11 is a block diagram showing a construction of a source driver LSI chip in the liquid crystal display device module.
Figure 12:
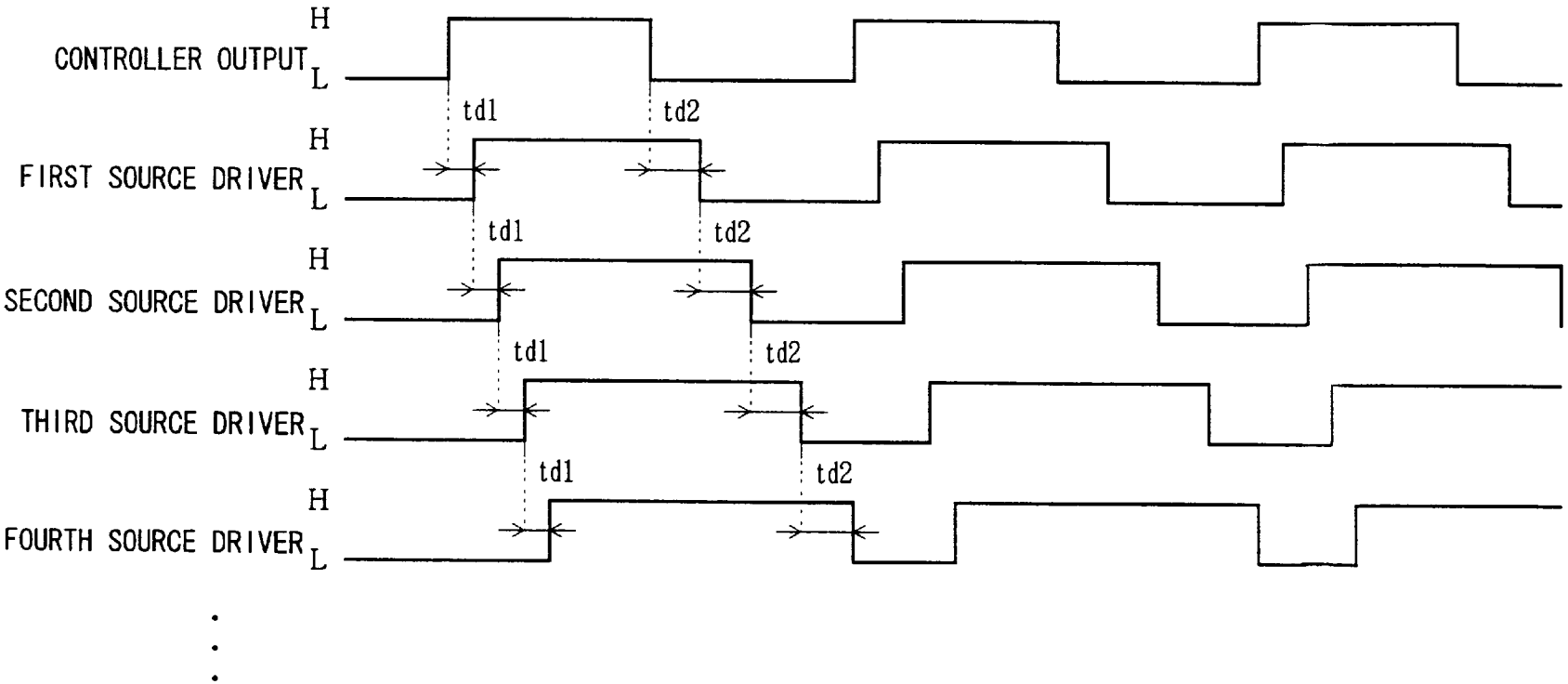
FIG.12 PRIOR ART
FIG. 12 is a timing chart showing a delay of a clock signal at a rise time and a fall time in each of the source drivers.

As shown in FIG. 9 (described later), the gate driver clock signal GCK from the first gate driver is outputted from a terminal GCKout, and the gate driver start pulse signal GSPO is outputted from a terminal GSPout. And then, the signals GCK and GSPO are inputted to the second gate driver of the next step. In the final step, the gate driver start pulse signal GSPO is inputted from the gate driver LSI chip 2 of the second gate driver to the controller circuit 6. Further, a source terminal Vcc, a GND line, and voltages Vref 1 and 2 applied to the liquid crystal panel are supplied as common signals from the controller circuit 6 to the gate driver LSI chips 2.

As described above, in the present embodiment, regarding the source driver LSI chips 1, the clock signal CK and the start pulse input signal SPI are inputted and outputted in a cascade connection from the controller 6 to the first through eighth source drivers. Also, the image data signals R·G·B are inputted and outputted in a cascade connection to the first through eighth source drivers.

Moreover, regarding the gate driver LSI chips 2, the gate driver clock signal GCK and the gate driver start pulse signal GSPI are inputted and outputted in a cascade connection from the controller 6 to the first and second gate drivers.

Therefore, the start pulse input signal SPI and the image data signals R·G·B from the controller circuit 6 to the source driver, and the gate driver start pulse signal GSPI from the controller circuit 6 to the gate driver, are propagated in a cascade connection to the semiconductor device of the present invention. Further, the clock signal CK from the controller circuit 6 to the source driver, and the gate driver clock signal GCK from the controller circuit 6 to the gate driver, serve as reference signals to be propagated in a cascade connection to the semiconductor device of the present invention.

Next, referring to FIG. 1, the following explanation fully describes a circuit of the source driver LSI chip 1.

The source driver LSI chip 1 provides a 64-gray scale display and drives 100 pixels×3(RGB). This arrangement is the same as that of the conventional art.

As shown in FIG. 1, the source driver LSI chip 1 has a circuit construction including a shift resistor circuit 11, an input inverse buffer circuit 12 serving as a half-period delaying means and an inverting means, a clock half-period delay circuit 13 serving as a half-period delaying means, a data latch circuit 14, a sampling memory circuit 15, a clock half-period delay circuit 16 serving as a half-period delaying means, a hold memory circuit 17, a reference source generating circuit 18, a DA converter circuit 19, and an output circuit 20.

Here, the present embodiment is different from the conventional source driver LSI chip as follows: the clock signal CK is inputted from the terminal CKin, is sent through the input inverse buffer circuit 12, and is inverted so as to be a clock of the shift resistor circuit 11; and the start pulse SPI signal is shifted in the shift resistor circuit 11, and is outputted via the half-period delay circuit 13 which delays a clock by a half period before being outputted from a terminal SPout; and the inputted 6-bit image data signals R·G·B are directed to the clock half-period delay circuit 16 which delays a clock by a half period as described above, before the image data signals R·G·B are inputted to the data latch circuit 14, and the image data signals R·G·B are outputted from the terminals R1-6out, G1-6out, and B1-6out via the clock half-period delay circuit 16.

As shown in FIG. 1, in the source driver LSI chip 1 having the above-mentioned construction, firstly, the clock signal CK is inputted from the terminal CKin, is inverted in the input inverse buffer circuit 12, and becomes a clock inverse signal/CK. And then, when the start pulse SPI signal, which is synchronized with a horizontal synchronization signal of the image data signals R·G·B, is inputted from the terminal SPin, the start pulse signal SPI begins to shift at the falling edge of a clock inverse signal/CK firstly inputted during a high-level period of the start pulse signal SPI.

The start pulse input signal SPI shifted in the shift resistor circuit 11 is delayed by a half clock period in the clock half-period delay circuit 13, and is outputted from a terminal SPout as a start pulse output signal SPO. The start pulse output signal SPO is inputted to a terminal SPin of the source driver LSI chip 1 of the second source driver.

The image data signals R·G·B, which are respectively constituted by 6-bit signals of R, G, and B, are synchronized at the rising edge of the clock signal CK, and are inputted from the controller circuit 6 to terminals R1-6in, G1-6in, and B1-6in of the source driver LSI chip 1 in the first source driver. The image data signals R·G·B are temporarily latched in the data latch circuit 14 and is sent to the sampling memory circuit 15.

The 6-bit image data signals R·G·B are inputted to the clock half-period delay circuit 16 which delays a clock by a half period, as well as to the data latch circuit 14. And then, the image data signals R·G·B are outputted from the terminals R1-6out, G1-6out, and B1-6out via the clock half-period delay circuit 16, and are respectively inputted to terminals R1-6in, G1-6in, and B1-6in of the source driver LSI chip 1 in the second source driver.

Figures 4A, 4B, 4C, 4D, 4E, 4F:
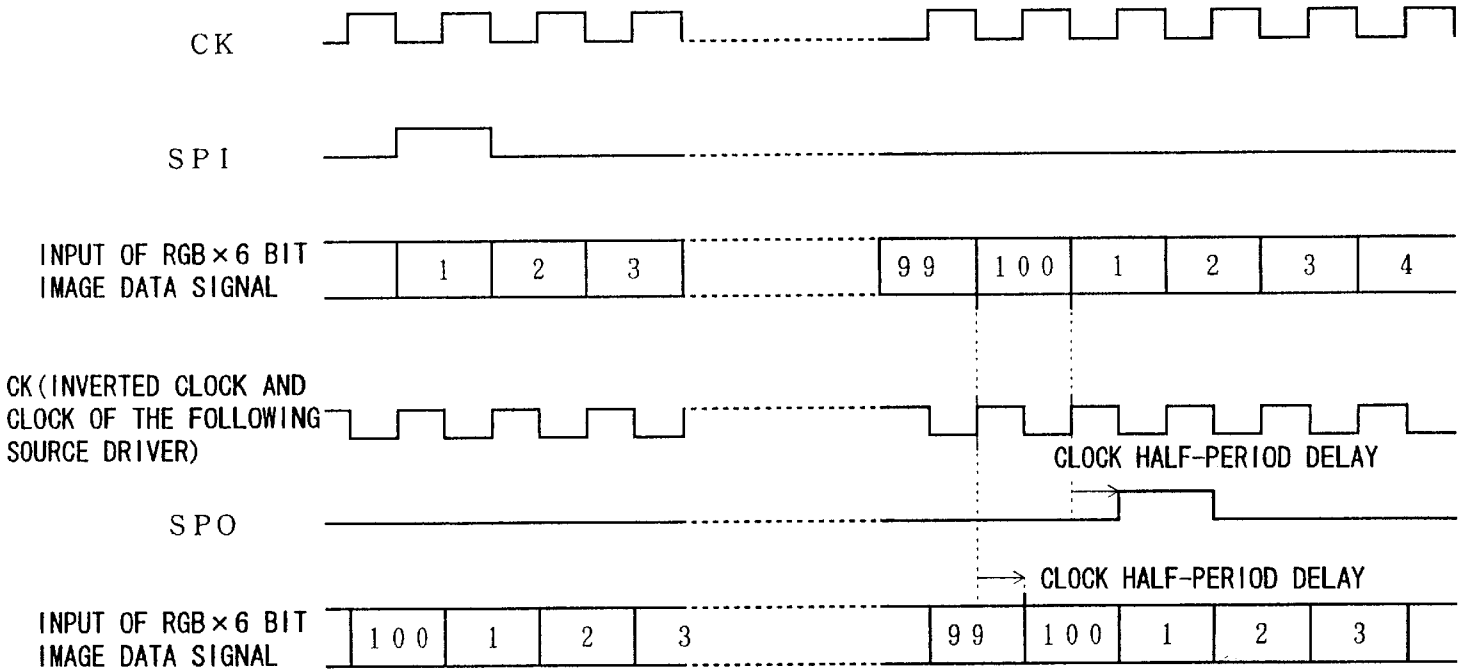
FIGS. 4(*a*) through 4(*f*) are timing charts showing each signal of the source driver LSI chips in odd-numbered source drivers.

Referring to FIGS. 4(*a*) through 4(*f*), the following explanation describes the relationship among the clock signal CK, the start pulse input signal SPI, and the image data signals R·G·B.

Initially, the clock signal CK is inputted (FIG. 4(*a*)), and is inverted in the input inverse buffer circuit 12 so as to be a clock inverse signal/CK (FIG. 4(*d*)). Next, at the first fall edge of the clock inverse signal/CK during a high-level period of the start pulse input signal SPI, the start pulse SPI signal begins to shift in the shift resister circuit 11. When 100-pixel data corresponding to a source driver (6-bit RGB signals are sent in parallel) are sent, the start pulse output signal SPO is outputted. Here, the clock of the start pulse output signal SPO is delayed by a half period in the clock half-period delay circuit 13 which delays the clock by a half period from the final step of the 100-pixel data (FIG. 4(*e*)).

Meanwhile, the image data signals R·G·B are also delayed in the clock half-period delay circuit 16 and are outputted (FIG. 4(*f*)).

Figure 5:
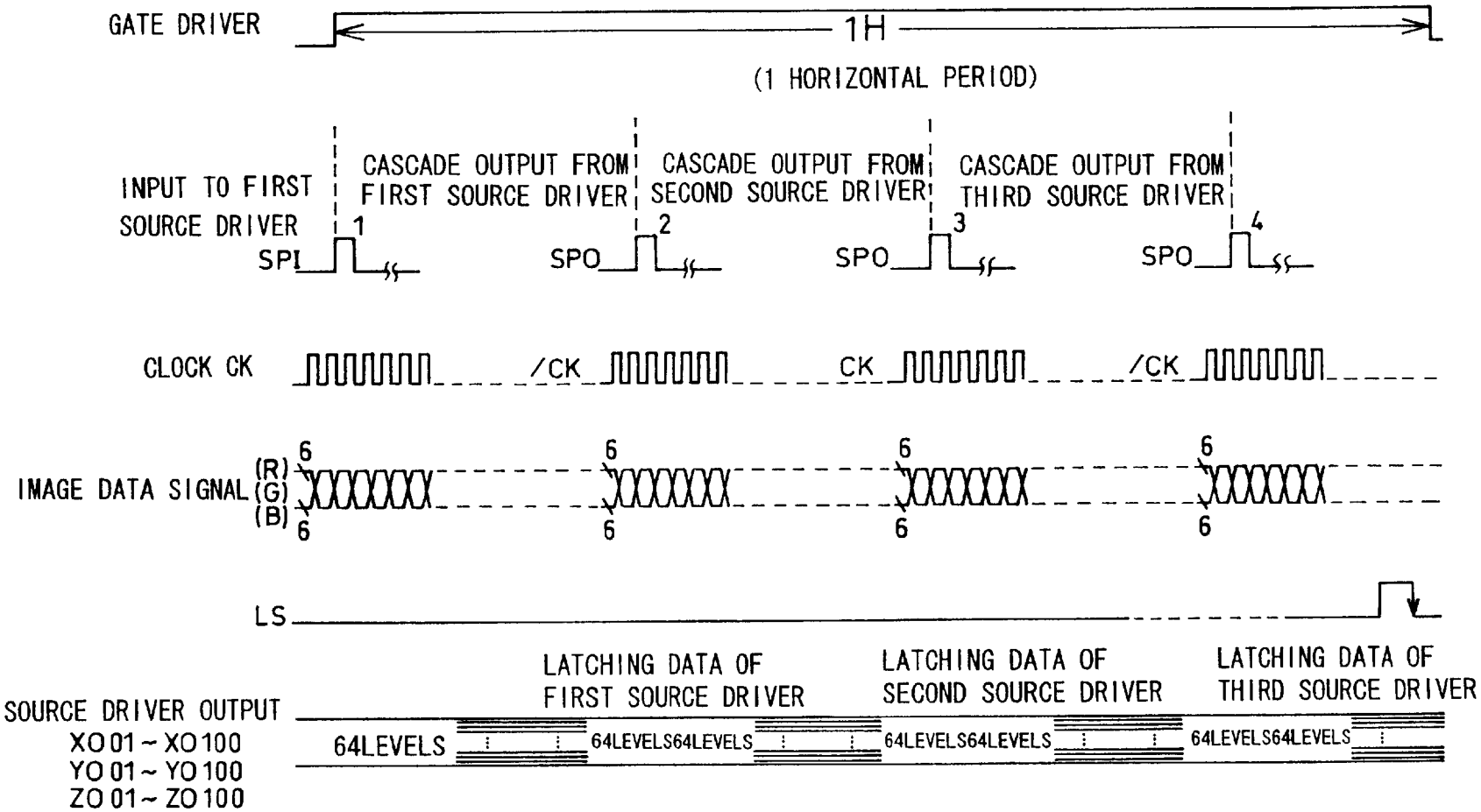
FIG. 5 is a timing chart showing input and output signals in each of the source drivers.

Consequently, as shown in FIG. 5, when the signals are inputted to the second source driver, the clock inverse signal/CK is inputted for a clock; meanwhile, upon inputting the start pulse output signal SPO and the image data signals R·G·B to the terminal SPin of the source driver LSI chip 1 in the second source driver, the clock half-period delay circuits 13 and 16 of the first source driver delay the clocks by a half period, so that the start pulse output signal SPO and the image data signals R·G·B are inputted the source driver LSI chip 1 of the second source driver in synchronization with a rise of the clock reverse signal/CK. Hence, the clock inverse signal/CK, the start pulse output signal SPO and the image data signals R·G·B have the same phases as the first source driver.

As described above, the odd-numbered first, third, fifth, seventh source drivers, and the even-numbered second, fourth, sixth, eighth source drivers have the same phases on input terminals of the source driver LSI chips 1; thus, it is possible to consider the phase in view of the operation of the source driver LSI chip 1 in the first source driver.

The clock inverse signal/CK or the clock signal CK, the start pulse input signal SPI, and the image data signals R·G·B are inputted to each of the source driver LSI chips 1, so that as shown in FIG. 1, the sampling memory circuit 15 samples the 6-bit image data signals R·G·B, 18 bits in total, that are sent in a time division, in accordance with a shift output signal (not shown) of each step of the start pulse input signal SPI in the shift resistor circuit 11, and the sampling memory circuit 15 stores the image data signals R·G·B until the latch signal LS is inputted.

The image signal data is subsequently inputted to the hold memory circuit 17 and is latched at the falling edge of the latch signal LS when the image data signals R·G·B of one horizontal period are inputted to the hold memory circuit 17. And then, the hold memory circuit 17 holds the data until data of the next horizontal period is inputted from the sampling memory circuit 15 to the hold memory circuit 17; meanwhile, the image signal data is outputted to the DA converter circuit 19.

At this time, the shift resister circuit 11 and the sampling memory circuit 15 capture another image data signals R·G·B of the next horizontal period.

Next, the reference source generating circuit 18 generates, for example, 64-level voltage used for a gradation display in a resistance division, in accordance with a reference voltage which is outputted from a terminal Vref1–9 of the controller circuit 6 and is inputted to a terminal Vref 1–9 of the source driver LSI chips 1.

The DA converter circuit 19 converts the image data signals R·G·B, in which each of digital signals R, G, and B is sent in 6-bit, to analog signals. And then, the output circuit 20 amplifies 64-level analog signals in accordance with a voltage inputted from an applied voltage adjusting terminal VLS to the liquid crystal panel 4, and the output circuit 20 outputs the analog signals from output terminals XO1-100, YO1-100, and ZO1-100, that respectively correspond to R·G·B, to terminals (not shown) of the liquid crystal panel 4.

Further, in FIG. 1, the terminals Vcc and GND of the source driver LSI chips 1 are terminals for power source supplied to the source driver LSI chips 1.

Figures 6A, 6B, 6C, 6D, 6E:
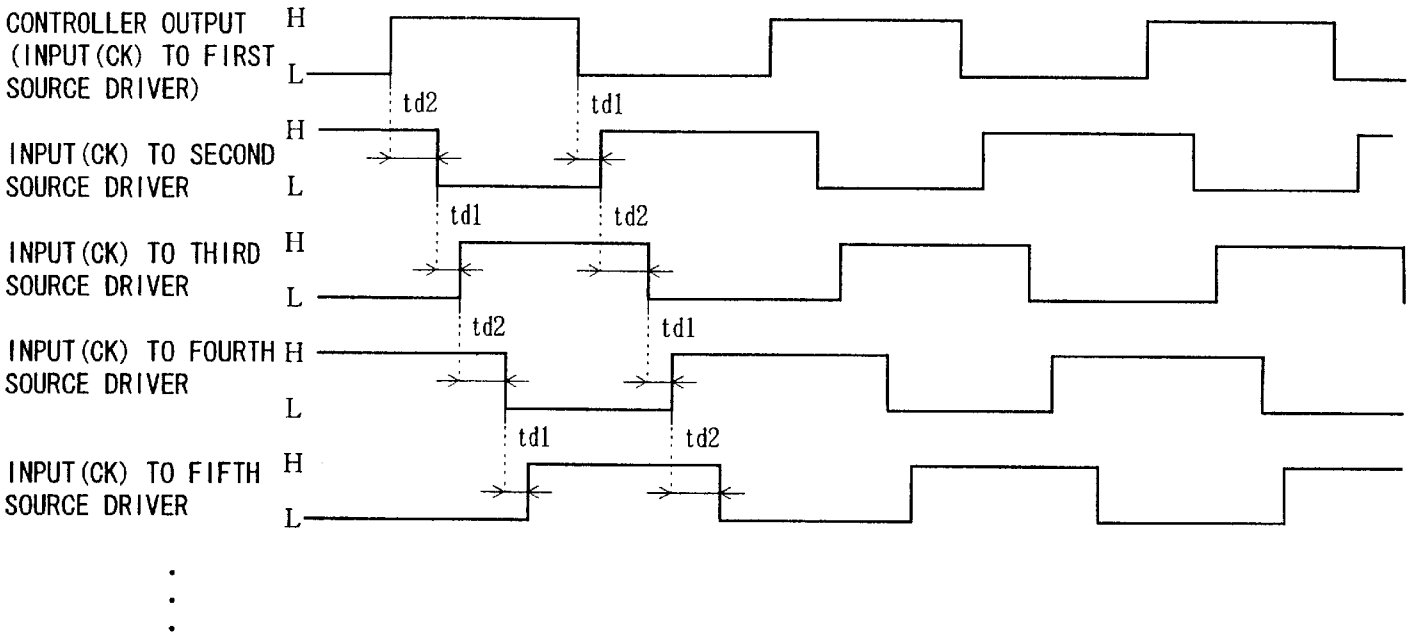
FIGS. 6(*a*) through 6(*e*) are timing charts showing a delay of a clock signal at a rise time and a fall time in each of the source drivers.

Next, referring to timing charts of FIGS. 6(*a*) through 6(*e*), the following explanation describes an operation of the clock signal CK in the present system construction. Here, in this explanation, the cascaded first through eighth source drivers are constituted by the source driver LSI chips 1 having virtually the similar properties. td1 represents a delay time at a rise time, and td2 represents a delay time at a fall time.

The clock signal CK is inputted from the controller circuit 6 to the first source driver. The clock signal CK is inverted in the first source driver and is inputted to the second source driver as the clock inverse signal/CK. The clock signal CK is inputted to the odd-numbered first, third, fifth, and seventh source drivers, and an inverted clock inverse signal/CK is inputted to the even-numbered second, fourth, sixth, and eighth source drivers.

For instance, as shown in FIG. 6(*c*), at an input to the third source driver, regarding an output from the controller circuit 6 (FIG. 6(*a*)), a delay time is td2+td1 at a rise time, and a delay time is td1+td2 at a fall time.

Namely, even when the td1 is different from the td2, a clock waveform, which is inputted to the odd-numbered first, third, fifth, seventh source drivers, is corrected so as to be identical to a controller output waveform.

Therefore, there is no accumulation of delay time differences in the cascade connection, so that even in the case of a faster clock and more cascade connections of the source drivers, the present embodiment makes it possible to propagate an appropriate clock to the eighth source driver serving as the last source driver, thereby eliminating the cause of a malfunction.

In this case, the input inverse buffer circuit 12 is constituted by, for example, a P channel MOS and an n channel MOS, that are normally used as inverters.

Further, for example, by using a D flip-flop, the clock half-period delay circuits 13 and 16 input (a) an output from the final step of the shift resister circuit 11 and (b) the image data signals R·G·B inputted to the source driver LSI chips 1. And as a clock of the D flip-flop, the clock half-period delay circuits 13 and 16 input a clock inputted to the source driver LSI chips 1 or an signal whose input inverse buffer output is further inverted; consequently, a desired output can be obtained.

And then, these are outputted from the output terminals of the source drivers LSI chips 1, so that it is possible to achieve the input inverse buffer circuit 12 and the clock half-period delay circuits 13 and 16 with a simple circuit, without greatly increasing the number of circuits.

The following explanation describes a construction of the liquid crystal display device module in accordance with the present embodiment.

In the liquid crystal display device module of the present embodiment (partially described above), as shown in FIG. 7, the output terminals of the TCPs 3 are subjected to a thermocompression bonding and are electrically connected to the terminals 4*b* made of ITO (Indium Tin Oxide) on the liquid crystal glass substrate 4*a* of the liquid crystal panel 4 via, for example, the ACF (Anisotropic Conductive Film) 4*c*.

Further, as shown in FIG. 2, the clock signal CK is wired, not via the flexible substrate 5. As described in the conventional art, this is because the adjacent TCP wires overlap each other at the ends so as to be electrically connected with each other.

Figure 8:
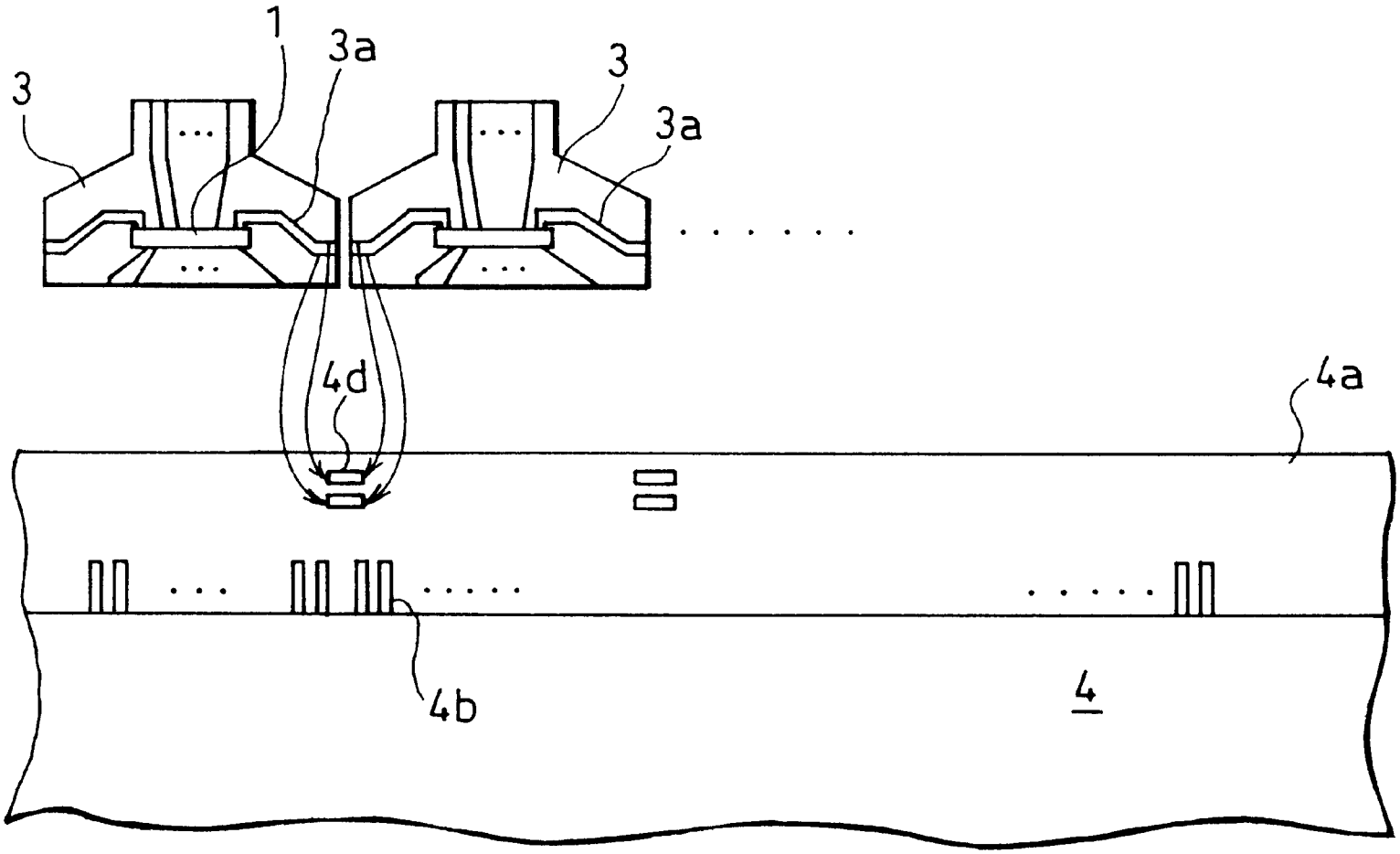
FIG. 8 is a schematic plan view showing a connection of TCPs of the liquid crystal panel of the liquid crystal display module.

Moreover, as shown in FIG. 8, in order to connect TCP wires 3*a* of the clock signal CK that are disposed toward the sides of the source driver LSI chips 1, source driver connecting wires (in FIG. 8, two wires are disposed) 4*d*, which are made of ITO as pixel terminals, are disposed on the liquid crystal glass substrate 4*a* serving as a lower glass of the liquid crystal panel 4. And the TCPs 3 are subjected to a thermal compression to the liquid crystal glass substrate 4*a* via the ACF 4*c*. This arrangement achieves an electrical connection at the same time.

Since a signal is speeding up or a source driver area is reduced in response to the need for a smaller system, the other wires may be connected in the above-mentioned method, not via the flexible substrate 5. Furthermore, it is possible to transmit all the signals of power sources, voltage Vrefs, latch signals LS, etc., that serve as common lines, from the TCP wire 3*a* to another, thereby eliminating the need for the flexible substrate 5. In this case, by using the data wires in the source drive LSI chips, the wiring of the common signals and power sources is arranged such that a terminal of the chip→a data wire in the chip→a terminal of the chip→a TCP wire→a terminal of the next chip.

The above-mentioned explanation described the source driver LSI chips 1. The method can be applied to the gate driver LSI chips 2 as well.

Namely, the gate driver does not need to operate at a high speed now; however, in response to the future need for a speedup due to an increase in the number of pixels, the arrangement of FIG. 9 can be adopted.

The gate driver LSI chip 2 of FIG. 9 is constituted by a shift resister circuit 31, an input inverse buffer circuit 32, a clock half-period delay circuit 33, a level shifter circuit 34, and an output circuit 35.

The shift resister circuit 31 shifts a start pulse generated in accordance with a horizontal synchronization signal of image data signals R·G·B, by using a gate driver clock inverse signal/GCK which is an inverse signal of the gate driver clock signal GCK, and the shift resister circuit 31 outputs a selection pulse for selecting a pixel of the liquid crystal panel 4.

The level shifter circuit 34 changes the selection pulse to a voltage level required for turning ON/OFF the TFT (Thin Film Transistor) of the liquid crystal panel 4. The output circuit 35 amplifies the signal in an internal output buffer circuit (not shown) and outputs the signal from output terminals OG1 through OGn to the liquid crystal panel 4.

Regarding the gate driver LSI chip 2, the same method is adopted as used for the source driver LSI chip 1, so that the detailed explanation thereof is omitted. As described above, the gate driver clock signal GCK is inverted in the gate driver LSI chip 2 by using the input inverse buffer circuit 32 (half-period delaying means, inverting means) so as to serve as a clock of the shift resistor circuit 31.

Further, the gate driver start pulse input signal GSPI is shifted in the shift resistor circuit 31, is delayed in the clock half-period delay circuit 33 serving as a half-period delaying means, and is inputted from the terminal GSPout to a GSPin terminal of the gate driver LSI chip 2 of the second gate driver, as a gate driver start pulse output signal GSPO.

The arrangement of the input inverse buffer circuit 32, the clock half-period delay circuit 33, and the wires are the same as those of the source driver.

Here, the above-mentioned input inverse buffer circuit 12 and input inverse buffer circuit 32 invert the clock signal CK or the gate driver clock signal GCK so as to obtain the clock inverse signal/CK or the gate driver clock inverse signal/GCK. Consequently, this arrangement delays the clock signal CK by a half period. Therefore, the input inverse buffer circuit 12 and the input inverse buffer circuit 32 act as a half-period delaying means as well as an inverting means of the present invention.

Moreover, the clock half-period delay can be arranged as follows:

$$\text{a clock half-period delay} \times (2n+1)(n=0, 1, 2 \ldots).$$

Additionally, the positions of the clock half-period delay circuits 13, 16 and 33 are not limited to the aforementioned positions as long as the cascaded source driver LSI chips 1 and the gate driver LSI chips 2 have the same phases upon inputting.

Further, in the above explanation, one-phase clock is taken as an example. However, a polyphase clock such as a two-phase clock can be readily adopted as well.

Also, the above explanation takes the liquid crystal display device module as an example. The driver of the present embodiment is effective for a device in which a plurality of the same drivers are cascaded so as to transfer a cascaded and propagated signal; thus, the present embodiment can be also adopted for a display device driving circuit of other display devices such as a plasma display.

As described above, according to the present embodiment, in the system construction in which a plurality of the same semiconductor devices are cascaded, it is possible to automatically correct a cascaded and transferred signal waveform by adding a relatively simple circuit; therefore, a malfunction and a halt of the system can be prevented so as to construct a highly reliable system.

Additionally, the present embodiment is quite effective in response to a speedup of a signal and an increase in the number of cascaded semiconductor devices, as for a display device which is expected to have more pixels and higher resolution.

Furthermore, the present embodiment is effective under severe conditions of the specification, including the minimum permissible time; therefore, it is possible to effectively realize a low-voltage driving and expand an operating temperature range, and a system design and an on-board design can be readily achieved for shrinking the size of the circumference of the liquid crystal panel 4.

As described above, in the system construction of the semiconductor device of the present embodiment, namely, the source drivers or the gate drivers have a plurality of the same source driver LSI chips 1 or the gate driver LSI chips 2 in cascade connections.

Further, to the source driver LSI chips 1, signals such as the start pulse input signal SPI and the image data signals R·G·B and a reference signal such as the clock signals CK are cascaded and propagated. Further, to the gate driver LSI chips 2, a signal such as the gate driver start pulse signal GSPI and a reference signal such as the gate driver clock signals GCK are cascaded and propagated.

The start pulse input signal SPI, the image data signals R·G·B, the clock signal CK cause delays in each of the source driver LSI chips 1. And the gate driver start pulse signal GSPI and the gate driver clock signal GCK cause delays in each of the gate driver LSI chips 2.

These delays are supposed to be equal at a rise time and a fall time of the signal and the reference signal; however, the delay times are different from each other in an actual operation. As a result, in the source driver LSI chip 1 of the eighth source driver serving as the last source driver, and in the gate driver LSI chip 2 of the second gate driver, the accumulation of the delay-time differences shortens low-level periods of the signal and the reference signal, resulting in problems including a malfunction and a halt of the system.

However, in the present embodiment, each of the source driver LSI chips 1 is provided with the input inverse buffer circuit 12 and the clock half-period delay circuits 13 and 16. With the input inverse buffer circuit 12 and the clock half-period delay circuits 13 and 16, the signal and the reference signal, that are cascaded and transmitted to the plurality of cascaded source driver LSI chips 1, are delayed by a half period of the clock signal CK and are outputted.

Namely, the signal such as the start pulse input signal SPI and the image data signals R·G·B and the reference signal such as the clock signal CK are delayed by a half-period of the clock signal CK, so that between the odd-numbered source driver LSI chips 1 and the even-numbered source driver LSI chips 1, it is possible to shift a rise time and a fall time of the signal and the reference signal. Therefore, even when each of the source driver LSI chips 1 has different delay times at a rise time and a fall time regarding the signal and the reference signal, the delay-time differences can be cancelled so as to cause no accumulation of the differences.

As a result, even in the case of a faster clock signal and the increased number of the cascaded source driver LSI chips 1, it is possible to propagate an appropriate clock to the source driver LSI chip 1 of the eighth source driver located at the end, so that the cause of a malfunction can be eliminated.

The same effect can be obtained for the gate driver LSI chips 2.

Hence, when the plurality of the same source driver LSI chips 1 or the gate driver LSI chips 2 are cascaded, it is possible to provide a system construction having the source driver LSI chips 1 and the gate driver LSI chips 2, that can prevent a malfunction and a halt of the system so as to construct a highly reliable system.

Further, according to the present embodiment, the system construction of the semiconductor devices is provided with the input inverse buffer circuit 12 which inverts the clock signal CK relative to an input signal. The clock signal CK is cascaded and propagated to the source driver LSI chips 1. Thus, the clock signal CK is inverted relative to an input signal in the input inverse buffer circuit 12, so that the input signal is delayed by a half-period of the clock signal CK. Namely, a half-period delay of the clock signal CK can be realized by inverting the clock signal CK. Consequently, the same effect can be achieved as that of the reference signal delayed by a half-period.

Therefore, as a half-period delaying means, signals such as the start pulse input signal SPI and the image data signals R·G·B are simply delayed by a half period of the reference signal, or the input inverse buffer circuit 12 inverts the clock signal CK so as to delay by a half period of the clock signal CK.

Moreover, with this arrangement, the start pulse input signal SPI, the image data signals R·G·B, and the clock signal CK are delayed by a half period of the clock signal CK relative to an input signal, so that between the odd-numbered source driver LSI chips 1 and the even-numbered source driver LSI chips 1, it is possible to shift a rise time and a fall time of the start pulse input signal SPI, the image data signals R·G·B, and the clock signal CK. Hence, even when the start pulse input signal SPI, the image data signals R·G·B, and the clock signal CK have different delay times at a rise time and a fall time in each of the source driver LSI chips 1, the differences can be cancelled so as to cause no accumulation of the delay-time differences. As a result, even when the clock signal CK speeds up and the number of the cascaded source driver LSI chips 1 increases, it is possible to propagate an appropriate clock to the source driver LSI chip 1 of the eighth source driver located at the end, so that the cause of a malfunction can be eliminated.

Further, the same effect can be achieved for the gate driver LSI chips 2. The half-period delaying means has the clock half-period delay circuit 33 for delaying the gate driver start pulse signal GSPI and the input inverse buffer circuit 32 for inverting the gate driver clock signal GCK. With this arrangement, even when the gate driver clock signal GCK speeds up and the number of the cascaded gate driver LSI chips 2 increases, it is possible to propagate an appropriate clock to the gate driver LSI chip 2 of the second gate driver located at the end, so that the cause of a malfunction can be eliminated.

Moreover, the input inverse buffer circuit 12 has merely a function of inverting the clock signal CK. Also, the input inverse buffer circuit 32 has merely a function of inverting the gate driver clock signal GCK. Therefore, the input inverse buffer circuits 12 and 32 have simple constructions.

Hence, in the case of a cascade connection of the plurality of the same source driver LSI chips 1 and the gate driver LSI chips 2, it is possible to provide the system construction of the semiconductor devices that can prevent problems such as a malfunction and a halt of the system with a simple construction so as to construct a highly reliable system.

Additionally, according to the present embodiment, in the system construction of the semiconductor devices, the start pulse input signal SPI and the image data signals R·G·B, that are cascaded and propagated to the plurality of the same cascaded source driver LSI chips 1, have the same phases at an input and output of the source driver LSI chips 1 of the first through eighth source drivers.

Consequently, in each of the source driver LSI chips 1, the start pulse input signal SPI and the image data signals R·G·B and other signals that are cascaded and propagated have the same input and output phases; thus, it is possible to provide the system construction of the semiconductor devices that can positively prevent a malfunction and a halt of the system so as to construct a highly reliable system.

Furthermore, according to the present embodiment, in the system construction of the semiconductor devices, the plurality of the same cascaded source driver LSI chips 1 and the gate driver LSI chips 2 constitute a display device driving circuit.

Therefore, when the plurality of the same source driver LSI chips 1 and the gate driver LSI chips 2 are cascaded in the display device driving circuit, it is possible to provide the system construction of the semiconductor devices that can prevent a malfunction and a halt of the system so as to construct a highly reliable system.

Further, according to the present embodiment, in the system construction of the semiconductor devices, the display device driving circuit is the liquid crystal display device driving circuit.

As a result, regarding the liquid crystal display device driving circuit serving as the display device driving circuit, when the plurality of the same source driver LSI chips 1 and the gate driver LSI chips 2 are cascaded, it is possible to provide the system construction of the semiconductor devices that can prevent a malfunction and a halt of the system so as to construct a highly reliable system.

Further, according to the present embodiment, in the system construction of the semiconductor devices, the liquid crystal display device driving circuit is a source driver.

Namely, regarding the first through eighth source drivers, the clock signal CK is required to speed up in response to a faster transfer of the image data signals R·G·B. Since the accumulation of the delay-time differences shortens low-level periods of signals including the start pulse input signal SPI and the image data signals R·G·B and a reference signal such as the clock signal CK, the source driver LSI chip 1 of the eighth source driver especially tends to cause a malfunction and a halt of the system.

Thus, the present system construction of the semiconductor devices is adopted for the first through eighth source drivers, so that when the plurality of the same source driver LSI chips 1 are cascaded in the source driver serving as a liquid crystal display device driving circuit, it is possible to provide the system construction of the semiconductor devices that can transfer the image data signals R·G·B at a high speed and prevent a malfunction and a halt of the system so as to construct a highly reliable system.

The liquid crystal display device module using the system construction of the semiconductor devices in accordance with the present embodiment has the system construction of semiconductor devices, in which the display device driving circuit is provided, or the display device driving circuit is a liquid crystal display device driving circuit.

Consequently, upon cascading the plurality of the same source driver LSI chips 1 and the gate driver LSI chips 2, it is possible to provide the liquid crystal display device module using the system construction of the semiconductor devices that can prevent a malfunction and a halt of the system so as to construct a highly reliable system.

As described above, a first system construction of semiconductors of the present invention, in which the plurality of the same semiconductor devices are cascaded, signals such as a start pulse signal and image data signals and a reference signal such as a clock signal are delayed in each of the semiconductor devices, the signals being cascaded and propagated to the semiconductor devices, and the delay times are different at a rise time and at a fall time of the signal, is characterized in that each of the semiconductor devices is provided with a half-period delaying means for delaying the signals and the reference signal cascaded and transmitted to the plurality of cascaded semiconductor devices by a half period of the reference signal and for outputting the signals.

Namely, upon cascading the plurality of the same semiconductor devices, and upon cascading and propagating the signals such as the start pulse signal and the image data signals and the reference signal such as the clock signal to the semiconductor devices, a delay appears in each of the semiconductor devices. These delays are supposed to be the same at a rise time and a fall time of the signals and the reference signal; however, these delay times are different from each other in an actual operation. As a result, in the eighth semiconductor device located at the end, the accumulation of the delay times shortens low-level periods of the signals and the reference signal so as to cause a malfunction and a halt of the system.

However, in the present invention, each of the semiconductor devices is provided with a half-period delaying means. The half-period delaying means delays the signals and the reference signal, that are cascaded and propagated to the plurality of cascaded semiconductor devices, by a half period of the reference signal, and the half-period delaying means outputs the signals.

Namely, the signals and the reference signal are delayed by a half period of the reference signal, so that between the odd-numbered semiconductor devices and the even-numbered semiconductor devices, it is possible to shift a rise time and a fall time of the signals and the reference signal. Therefore, when the signals and the reference signal have different delay times at a rise time and fall time in each of the semiconductor devices, it is possible to cancel the differences so as to cause no accumulation of the delay times. Consequently, when the reference signal speeds up, namely, for example, when the clock speeds up and the number of the cascaded semiconductor devices increases, it is possible to propagate an appropriate clock to the semiconductor device located at the end so as to eliminate the cause of a malfunction.

Hence, when the plurality of the same semiconductor devices are cascaded, it is possible to provide the system construction of the semiconductor devices that can prevent a malfunction and a halt of the system so as to construct a highly reliable system.

A second system construction of the semiconductors of the present invention, in which the plurality of the same semiconductor devices are cascaded, a signal and a reference signal being cascaded and propagated to the semiconductor devices are delayed in each of the semiconductor devices, and the delay times are different at a rise time and at a fall time of the signal, is characterized in that each of the semiconductor devices is provided with a half-period delaying means for delaying the signals and the reference signal cascaded and propagated to the plurality of cascaded semiconductor devices by a half period of the reference signal and for outputting the signals; and the half-period delaying means is provided with an inverting means for inverting the reference signal cascaded and propagated to the semiconductor device relative to the input signal.

Namely, when the plurality of the same semiconductor devices are cascaded, and signals such as the start pulse signal and the image data signals and a reference signal such as the clock signal are cascaded and propagated to the semiconductor devices, a delay appears in each of the semiconductor devices. These delays are supposed to be the same at a rise time and a fall time of the signals and the reference signal; however, these delay times are different from each other in an actual operation. As a result, in the semiconductor device located at the end, the accumulation of the delay times shortens low-level periods of the signal and the reference signals so as to cause a malfunction and a halt of the system.

However, in the present invention, each of the semiconductor devices is provided with the half-period delaying means. The half-period delaying means delays the signals and the reference signal, that are cascaded and propagated to the plurality of cascaded semiconductor devices, by a half period of the reference signal, and the half-period delaying means outputs the signals. Further, the half-period delaying means is provided with the inverting means for inverting the reference signal cascaded and transmitted to the semiconductor device, relative to the input signal; thus, the inverting means inverts the reference signal relative to the input signal by a half period of the reference signal. In other words, the reference signal is inverted so as to have a delay of a half period of the reference signal. In the end, the same effect can be achieved as in the case of the signal delayed by a half period of the reference signal.

Hence, the half-period delaying means simply delays the signal by a half period of the reference signal, or the half-period delaying means allows the inverting means to invert the reference signal so as to delay the signal by a half period of the reference signal.

Further, with this arrangement, the signals and the reference signal are delayed by a half period of the reference signal relative to the input signal, so that between the odd-numbered semiconductor devices and the even-numbered semiconductor devices, it is possible to shift a rise time and a fall time of the signals and the reference signal. Therefore, when the signals and the reference signal have different delay times at a rise time and fall time in each of the semiconductor devices, it is possible to cancel the differences so as to cause no accumulation of the delay times.

Consequently, when the reference signal speeds up, namely, for example, when the clock speeds up and the number of the cascaded semiconductor devices increases, it is possible to propagate an appropriate clock to the semiconductor device located at the end so as to eliminate the cause of a malfunction.

Moreover, the inverting means has merely a function of inverting the reference signal, so that the construction is simple.

Therefore, when the plurality of the same semiconductor devices are cascaded, it is possible to provide the system construction of the semiconductor devices that can prevent problems such as a malfunction and halt of the system with a simple construction, so that a highly reliable system can be achieved.

With the arrangement of the first or second system construction of the semiconductors, a third system construction of the semiconductor devices is characterized in that the signals, which are cascaded and propagated to the plurality of the same cascaded semiconductor devices, have the same phases at an input and output of each of the semiconductors.

The present invention allows the signals, which are cascaded and propagated to the plurality of the same cascaded semiconductor devices, to have the same phases at an input and output of each of the semiconductors.

Consequently, in each of the semiconductor devices, the cascaded and propagated signals have the same phases at an input and output; thus, it is possible to provide the system construction of the semiconductor devices that can positively prevent a malfunction and a halt of the system so as to achieve a highly reliable system.

With the arrangement of the first, second, or third system construction of the semiconductors, a fourth system construction of the semiconductor devices is characterized in that the plurality of the same cascaded semiconductor devices constitute a display device driving circuit.

In the above invention, the plurality of the same cascaded semiconductor devices constitute the display device driving circuit.

As a result, the display device driving circuit can achieve the same effect as the first, second, or third system construction of the semiconductor devices.

With the arrangement of the fourth system construction of the semiconductors, a fifth system construction of the semiconductor devices is characterized in that the display device driving circuit is a liquid crystal display device driving circuit.

In the above invention, the display device driving circuit is a liquid crystal display device driving circuit.

Consequently, the liquid crystal display device driving circuit, which serves as the display device driving circuit, can achieve the same effect as the first, second, or third system construction of the semiconductor devices.

With the arrangement of the fifth system construction of the semiconductors, a sixth system construction of the semiconductor devices is characterized in that the liquid crystal display device driving circuit is a source driver.

In the above invention, the liquid crystal display device driving circuit is a source driver.

Namely, regarding the source driver, the reference signal needs to speed up in response to faster transfer of the image data signals; thus, the accumulation of the delay-time differences shortens the low-level periods of the signals and the reference signal, so that a malfunction and a halt tend to occur.

Therefore, the system construction of the semiconductor devices of the present invention is adopted as a source driver, so that when the plurality of the same source drivers are cascaded as source drivers of the liquid crystal display device driving circuit, it is possible to provide the system construction of the semiconductor devices that can transfer the image data signals at a high speed and prevent problems such as a malfunction and a halt of the system so as to construct a highly reliable system.

The liquid crystal display device module using a seventh system construction of the semiconductor devices is characterized by including the fourth or fifth system construction of the semiconductor devices.

According to the above invention, in the liquid crystal display device module, the fourth or fifth system construction of the semiconductor devices, namely, the plurality of the same semiconductor devices constitute the display device driving circuit, or the display device driving circuit acts as the liquid crystal display device driving circuit.

Consequently, when the plurality of the same semiconductor devices are cascaded, it is possible to provide the liquid crystal display device module using the system construction of the semiconductor devices that can prevent a malfunction and a halt of the system so as to construct a highly reliable system.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A system construction of semiconductor devices, in which a plurality of semiconductor devices similar to each other are cascaded, wherein:

each of the plurality of semiconductor devices has input signals of a reference signal and a propagation signal which are cascaded and propagated in the plurality of semiconductor devices, and each of the plurality of semiconductor devices includes:

first half-period delaying means which delays the reference signal to be output by a half period of the reference signal, and second half-period delaying means which delays the propagation signal to be output by the half period of the reference signal.

2. The system construction of the semiconductor devices as defined in claim 1, wherein said first half-period delaying means includes inverting means for inverting said reference signal, which is cascaded and propagated to the plurality of semiconductor devices.

3. The system construction of the semiconductor devices as defined in claim 1, wherein said first half-period delaying means inverts said reference signal; meanwhile, said second half-period delaying means delays said propagation signal by a half period of said reference signal before outputting said propagation signal.

4. The system construction of the semiconductor devices as defined in claim 1, wherein input and output of said propagation signal are in phase in each of said plurality of semiconductor devices.

5. The system construction of the semiconductor devices as defined in claim 1, wherein said plurality of semiconductor devices constitute a display device driving circuit.

6. The system construction of the semiconductor devices as defined in claim 5, wherein said display device driving circuit is a source driver.

7. The system construction of the semiconductor devices as defined in claim 6, wherein said propagation signal includes a source driver start pulse signal.

8. The system construction of the semiconductor devices as defined in claim 6, wherein said propagation signal includes an image data signal.

9. The system construction of the semiconductor devices as defined in claim 5, wherein said display device driving circuit is a gate driver.

10. The system construction of the semiconductor devices as defined in claim 9, wherein said propagation signal includes a gate driver start pulse signal.

11. The system construction of the semiconductor devices as defined in claim 5, wherein said display device driving circuit is a liquid crystal display device driving circuit.

12. The system construction of the semiconductor devices as defined in claim 11, wherein said liquid crystal display device driving circuit is a source driver.

13. A liquid crystal display device module comprising said system construction of the semiconductor devices that is defined in claim 11.

14. A system construction of semiconductor devices, in which a plurality of semiconductor devices similar to each other are cascaded, wherein:

a signal and a reference signal which are cascaded and propagated in each the plurality of semiconductor devices are delayed in each of the plurality semiconductor devices, and delay times associated with each of the plurality of semiconductor devices are different at a rise time and at a fall time, each of the plurality of semiconductor devices includes:

first half-period delaying means which delays the signal to be output by a half period of the reference signal, and second half-period delaying means which delays the reference signal to be output by the half period of the reference signal.

15. The system construction of semiconductor devices as set forth in claim 1, wherein the reference signal is a clock signal.

16. The system construction of semiconductor devices as set forth in claim 1, wherein the propagation signal is latched in synchronization with the reference signal.

17. The system construction of semiconductor devices as set forth in claim 1, wherein the second half-period delaying means delays the propagation signal before being latched.

18. The system construction of semiconductor devices as set forth in claim 14, wherein the reference signal is a clock signal.

19. The system construction of semiconductor devices as set forth in claim 14, wherein the propagation signal is latched in synchronization with the reference signal.

20. The system construction of semiconductor devices as set forth in claim 14, wherein the second half-period delaying means delays the propagation signal before being latched.

* * * * *